US005835012A

United States Patent [19]

Wilk

[11] Patent Number: 5,835,012

[45] **Date of Patent: *Nov. 10, 1998**

[54] PROTECTIVE DEVICE FOR STORAGE AND TRANSPORT CONTAINERS

[75] Inventor: Peter J. Wilk, New York, N.Y.

[73] Assignee: Wilk Patent Development Corporation, New York, N.Y.

[ * ] Notice: The term of this patent shall not extend beyond the expiration date of Pat. No. 5,528,228.

[21] Appl. No.: 878,321

[22] Filed: Jun. 18, 1997

[51] Int. Cl.[6] ..... G08B 1/08

[52] U.S. Cl. ..... 340/539; 340/584; 340/686; 340/429; 379/58; 200/61.45 R

[58] Field of Search ..... 340/426, 429, 340/431, 441, 440, 449, 459, 460, 529, 539, 585, 586, 588, 825.15, 825.32; 379/58; 200/61.45 R

[56] References Cited

U.S. PATENT DOCUMENTS

| | | | |
|---|---|---|---|
| 3,909,568 | 9/1975 | Greenburg | 116/114 |
| 3,961,323 | 6/1976 | Hartkorn | 340/571 |
| 4,462,023 | 7/1984 | Nielsen et al. | 340/571 |
| 4,685,061 | 8/1987 | Whitaker | 340/441 |
| 4,688,244 | 8/1987 | Hannon et al. | 379/58 |
| 4,750,197 | 6/1988 | Denekamp et al. | 379/58 |
| 4,841,285 | 6/1989 | Laut | 340/571 |
| 5,027,105 | 6/1991 | Dailey et al. | 340/571 |
| 5,051,725 | 9/1991 | Caccitolo | 340/571 |
| 5,153,561 | 10/1992 | Johnson | 340/571 |
| 5,347,274 | 9/1994 | Hassett | 340/988 |
| 5,392,031 | 2/1995 | Toriumi et al. | 340/588 |
| 5,528,228 | 6/1996 | Wilk | 340/686 |

*Primary Examiner*—Edward Lefkowitz
*Assistant Examiner*—Daryl C. Pope
*Attorney, Agent, or Firm*—R. Neil Sudol; Henry D. Coleman

[57] ABSTRACT

A protective method for storage and transport containers comprises a sensor for detecting orientation, an attachment element for securing the sensor to a container, and an alarm operatively coupled to the sensor for generating a cognizable alert signal upon detection by the sensor that the container is in an orientation other than a predetermined preferred orientation. The alarm may include an electroacoustic transducer and means for reproducing a voice message. A timer operatively connected to the sensor measures a time interval during which the container is in an orientation other than the preferred orientation. A memory is operatively connected to the timer for automatically storing the time interval in encoded form. A mechanism and/or circuit may be operatively connected to the timer and the memory for deactivating the timer and for locking the memory to ensure integrity of contents of the memory upon an opening of the container. The method may also include a detector for measuring temperature. The alarm is operatively connected to the detector for generating a cognizable indicator signal upon measurement of a temperature beyond a pre-established threshold. The timer is operatively connected to the temperature detector for measuring a time period during which the container is in a temperature range beyond the threshold, while the memory is operatively connected to the timer for automatically storing the time period in encoded form.

15 Claims, 3 Drawing Sheets

PROTECTIVE DEVICE FOR STORAGE AND TRANSPORT CONTAINERS

BACKGROUND OF THE INVENTION

This invention relates mainly to a protective device for storage and transport containers. This invention also relates to an associated method for use in protecting contents of storage and transport containers.

A long standing problem in the shipping industry is damage to shipped goods. Containers holding fragile items are universally labeled with warnings such as "fragile" and "this side up." Despite such precautions, packages are nevertheless frequently subjected to treatment which damages their contents.

Besides impacts and misorientation, packages are sometimes subjected to other inordinately extreme conditions such as very low temperatures and severe jostling or shaking.

OBJECTS OF THE INVENTION

An object of the present invention is to provide a device attachable to a shipping container for aid in alleviating at least one of the above-mentioned conditions.

Another, more particular, object of the present invention is to provide such a device which assists in reducing the incidence of misorientation of packages during shipment and storage.

A further object of the present invention is to provide a device which can be used, for instance, by the insurance industry to at least partially determine treatment of a package during shipment.

Yet another object of the present invention is to provide an associated method for reducing the incidence of misorientation of packages during shipment and storage.

These and other objects of the present invention will be apparent from the drawings and detailed descriptions herein.

SUMMARY OF THE INVENTION

A protective device for storage and transport containers comprises, in accordance with the present invention, a sensor for detecting a physical condition of a predetermined kind and an attachment or connector for securing the sensor to a container. A timer is operatively connected to the sensor for determining that the detected physical condition has continued longer than a preselected duration. A wireless telecommunications transmitter is operatively connected to the timer for establishing a wireless telecommunications link to a predetermined remote receiver and transmitting, over the link to the receiver, a message that the detected physical condition has existed longer than the predetermined duration.

Where the physical condition is orientation of the container, the sensor includes components for detecting that the container is in an orientation other than a predetermined preferred orientation.

According to another feature of the present invention, the device further comprises a timing element operatively connected to the sensor for measuring a time interval during which the container is in an orientation other than the preferred orientation. A memory is operatively connected to the timing element for automatically storing the time interval in encoded form.

In addition, the device may further comprise a locking component operatively connected to the timing element and the memory for deactivating the timing element and for locking the memory to ensure integrity of contents of the memory upon an opening of the container.

Where the physical condition is temperature, the sensor includes means for detecting that the container has a temperature beyond a predetermined threshold. A timing element may be operatively connected to the sensor for measuring a time period during which the container is in a temperature range beyond the threshold, a memory being operatively connected to the timing element for automatically storing the time period in encoded form.

The storage of data on the periods of inappropriate conditions of the container provides a check on the care taken by the shipper. The device can be returned to the manufacturer for determining the shipment history with regard to the orientation of the container and its contents. This shipment history information is valuable to insurers (including the manufacturer under warranty) for allocating responsibility and liability.

The mechanism and/or circuit operatively connected to the timing element and the memory for deactivating the timing element and for locking the memory to ensure integrity of contents of the memory upon an opening of the container may include a switch or circuit tied to the lid of the container, e.g., via a string, wire or thread.

This feature of the invention serves to prevent a shipper from removing the device from a shipping container and reprogramming the memory before the device is returned to the manufacturer. Generally, it is contemplated that the buyer or other receiver of the shipped goods removes the protective device and returns it to the manufacturer. Of course, the sensor may also be deactivated so that it is inoperative during the return trip to the manufacturer. The memory also contains a recording of the time that the container was opened. If opening occurs prior to receipt by the customer, then a legal cause of action against the shipper may be entertained.

A method for use in protecting contents of storage and transport containers comprises, in accordance with the present invention, automatically and at least periodically monitoring a storage and transport container with fragile contents to detect whether the container has a pre-established physical condition. In the event that the container has the pre-established physical condition, it is automatically determined whether the container has had the pre-established physical condition for a time interval longer than a preselected duration. Upon determining that the container has had the pre-established physical condition for a time interval longer than the preselected duration, a wireless telecommunications link is established to a predetermined remote receiver. Upon the establishing of the link, a message is transmitted over the link to the receiver, the message informing that the container has had the pre-established physical condition for a time interval longer than the preselected duration.

Where the physical condition is an orientation other than a predetermined preferred orientation, the monitoring of the container includes detecting that the container is in an orientation other than the preferred orientation. Optional steps of the method are automatically measuring a time interval during which the container is in an orientation other than the preferred orientation and automatically storing the time interval in encoded form in a memory. The memory is preferably locked to ensure integrity of contents of the memory upon an opening of the container.

Wherein the physical condition is a temperature beyond a predetermined threshold, the monitoring of the container includes detecting that the container has a temperature in a range beyond the predetermined threshold. In that case, optional steps of the method include measuring a time period during which the container is in a temperature range beyond the threshold and automatically storing the time period in encoded form in a memory.

According to another feature of the present invention, the method includes automatically generating an alarm signal cognizable within a region about the container, upon detecting that the container has the pre-established physical condition. The generating of the alarm signal may include producing a sound wave via an electroacoustic transducer. The step of producing a sound wave may include the step of producing a voice message such as "Please straighten me out" or "Attention, attention, turn this box upright."

If perishable food or temperature sensitive equipment is being shipped in the container, an alarm sounds when the temperature of the container rises beyond a predetermined maximum. If living organisms are being shipped, then an alarm will sound if the temperature of the container falls below a pre-established minimum.

A device in accordance with the present invention provides an alarm signal to a remote location via a wireless telephone link in the event that a container with valuable contents is subjected to an undesirable and possibly damaging physical condition for longer than a prescribed period. Thus, the shipper, the addressee or other concerned party can take steps to trace the location or the container and/or alert responsible parties to rectify the undesirable situation. This procedure is in addition to providing a stimulus or reminder to shipping personnel at or about the location of the container to correct an unwanted condition of the container and its contents. Thus, the present invention serves as a supplement to the device and method described and claimed in U.S. Pat. No. 5,528,228.

The present invention is useful, for instance, where a container is placed in a cargo hold or other storage location which is not easily accessed by shipping, handling, or caretaker personnel. In such situations, even though an alarm may continue to be generated at the container for a substantial interval, the shipping, handling, or caretaker personnel may not be cognizant of the errant condition.

Other conditions of a container during shipment may be monitored and recorded. For example, the size and frequency of impacts may be monitored by a strain gauge network embedded in a flexible or resilient matrix and connected to an inertial mass also embedded in the matrix. The strain gauges are operatively connected to a monitoring circuit including a timer and a memory.

DETAILED DESCRIPTION

Figure 1:
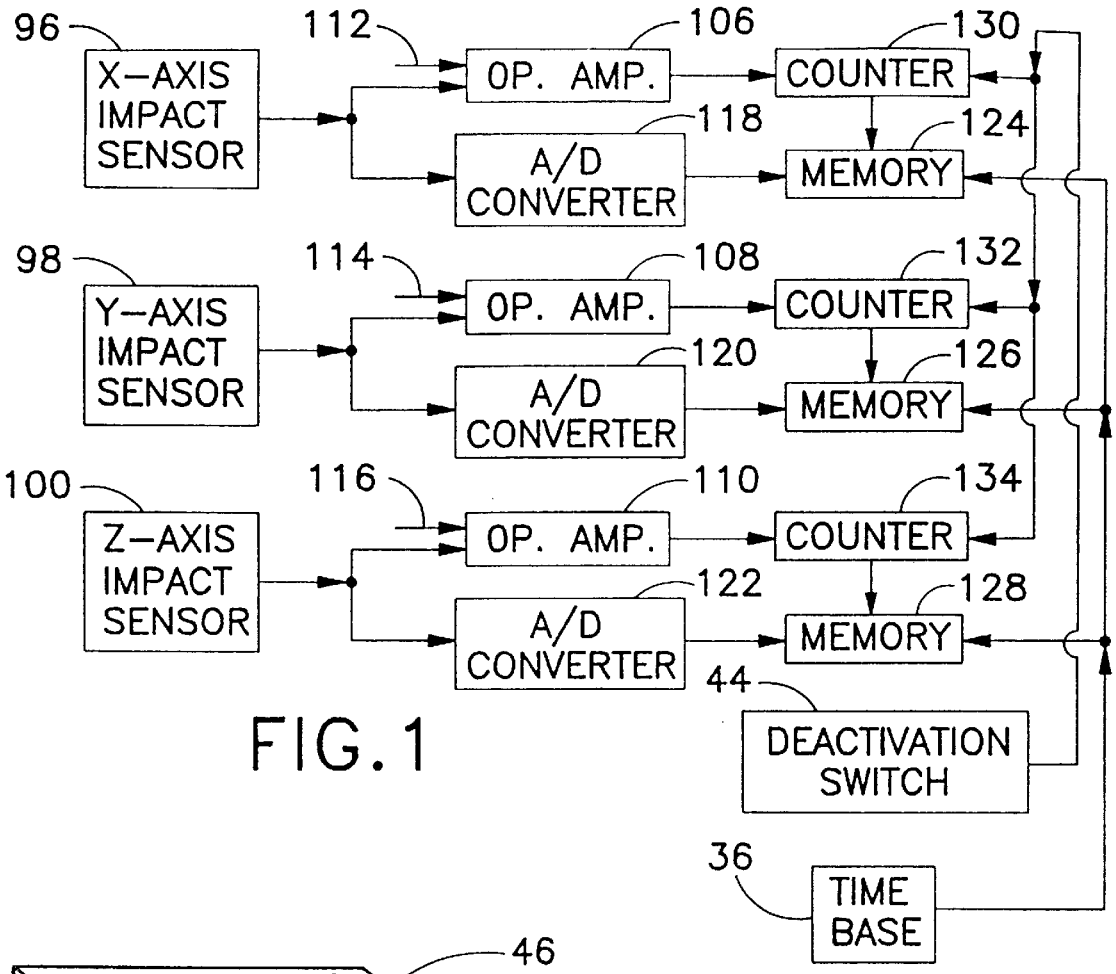
FIG. 1 is a schematic perspective view, on a reduced scale, of a protective device for storage and transport containers, showing disposition of the device in a shipping container, in accordance with the present invention.

As shown in FIG. 1, a protective device 10 for monitoring shipping conditions undergone by a storage and transport container 12 includes a housing or casing 14 attached via an adhesive layer 16, bolts (not shown) or other fastening elements to a side panel 18 of container 12.

Figure 2:
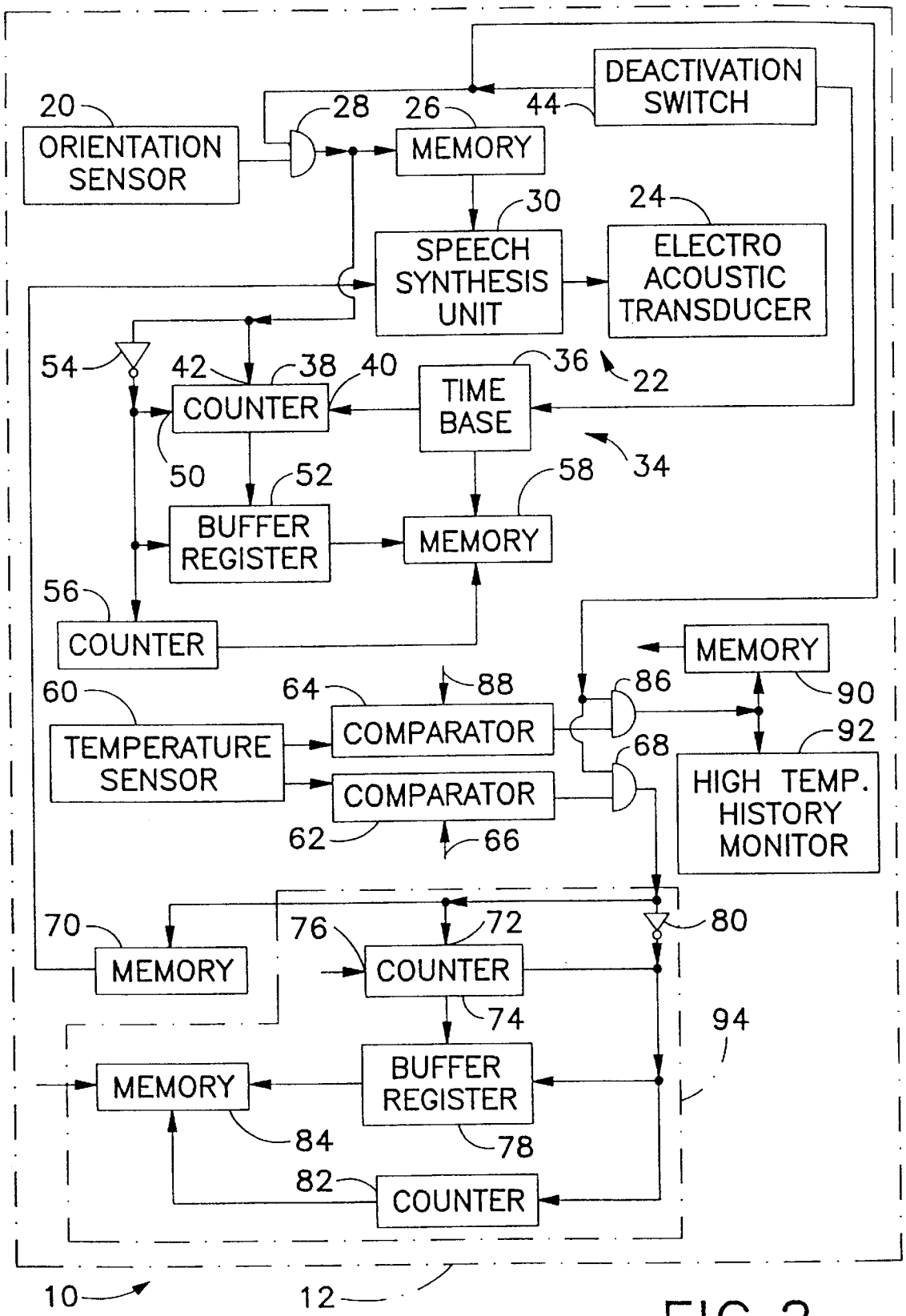
FIG. 2 is a block diagram of selected functional components of the protective device of FIG. 1.

As illustrated in FIG. 2, protective device 10 comprises a sensor 20 for detecting orientation and alarm componentry 22 operatively coupled to the sensor for generating a cognizable alert signal upon detection by the sensor that the container is in an orientation other than a predetermined preferred orientation. Sensor 20 may incorporate a gravity switch (not separately shown) for detecting when container 12 is not in an upright orientation.

Alarm componentry 22 includes an electroacoustic transducer 24 and a solid state memory 26. Memory 26 stores at least one digitally encoded voice message such as "Box not in correct orientation," "Please place container in upright position," "I am on my side; please stand me up." Upon receiving an activation signal from sensor 20 via an AND gate 28, memory 26 transmits the digitally encoded warning or command to a speech synthesis unit 30. Speech synthesis unit 30 converts the digitally encoded voice message from memory 26 into an analog signal which is fed to an electroacoustic transducer 24 for acoustic reproduction.

Memory 26 and speech synthesis unit 30 may be replaced with an equivalent combination of elements such as a recording tape (not shown) and an audio playback unit (not shown).

The alarm componentry 22 of protective device 10 provides a stimulus or reminder to shipping personnel to right a misoriented package. Generally, it is contemplated that the alarm continues to sound until the container is placed in its preferred orientation.

As further illustrated in FIG. 2, device 10 also comprises a timer 34 including a time base 36 and a counter 38. Time base 36 generates a clock signal which is fed to an incrementing input 40 of counter 38 for measuring a time interval during which container 12 is in an orientation other than the upright orientation. The contents of counter 38 are incremented by the clock signal from time base 36 as long as an enabling input 42 of counter 38 is provided with a high logic signal. Counter input 42 is operatively connected to orientation sensor 20 via AND gate 28. Thus, counter 38 continues to measure time as long as orientation sensor 20 detects a misorientation of container 12 and as long as a de-activation switch 44 is transmitting a high logic signal to AND gate 28. Switch 44 changes its output to a low logic signal only upon the opening of container 12. To that end, switch 44 is connected to a lid 46 of container 12 via a wire 48 (FIG. 1).

Orientation sensor 20 is connected to a resetting input 50 of counter 38 and to an enabling input of a buffer register 52 via an inverter 54. Upon the righting of container 12 and a consequent reversion of the output of orientation sensor 20 to a low logic level from a high logic level, a high level logic signal from inverter 54 causes the contents of counter 38 to be transferred to buffer register 52 and induces the resetting of counter 38.

Inverter 54 is also connected to an incrementing input of a counter 56 which acts as an addressing and writing control for a solid state random access memory 58. Upon the incrementing of the contents of counter 56, the encoded time interval stored in buffer register 52 is transferred to an address location in memory 58 specified by the updated contents of counter 56. The time at which the loading of the encoded time interval into memory 58 occurs may also be stored in memory 58. This time is loaded from time base 36.

Thus, memory 58 contains an account or record of the intervals of misorientation of container 12. This record is terminated upon the opening of lid 46 and the consequent transmission of a low logic level disabling signal from switch 44 to AND gate 28. This disabling or deactivation signal effectively serves to lock memory 58.

Switch 44 may also be connected to time base 36 and at least indirectly to memory 58 for storing the time at which the container is opened. This time should correspond to the arrival of the container at the customer's location.

The contents of memory 58 enable a manufacturer to check on the care taken by a shipper or carrier. Device 10 can be returned to the manufacturer for determining the shipment history with regard to the orientation of the container and its contents. This shipment history information may be used by insurers for allocating responsibility and liability.

As additionally illustrated in FIG. 2, device 10 further comprises a detector or sensor 60 for measuring temperature. Alarm componentry 22 is operatively connected to temperature sensor 60 for generating a cognizable indicator signal upon measurement of a temperature beyond a pre-established threshold. To implement that function, sensor 60 is connected at an output to a pair of comparators 62 and 64 which may be analog elements such as operational amplifiers. Upon a falling of the temperature of container 12 below a predetermined minimum threshold (encoded in an input signal 66 to comparator 62), comparator 62 generates a signal of a high logic level which is fed to an AND gate 68. Provided that switch 44 is not generating a disabling signal, AND gate 68 passes the high logic level signal from comparator 62 on to a solid state memory 70. Memory 70 is enabled by that high logic level signal to transmit a digitally encoded voice message to speech synthesis unit 30. The message may be, for example, the words "I am too cold; please turn up the heat," or "Temperature below minimum limit; please reset temperature."

AND gate 68 is also connected to an enabling input 72 of a counter 74 which has an incrementing input 76 connected to time base 36 for receiving the clock signal output thereof. Counter 74 has an output connected to a buffer register 78 for loading a measured time interval into the buffer register upon the detection by sensor 60 of a decrease in temperature beyond the pre-established minimum. Sensor 60 is connected to an enabling or writing input of buffer register 78 via an inverter 80, as well as via comparator 62 and AND gate 68. Upon the appearance of a high logic level signal at the output of inverter 80, the contents of counter 74 are transferred to register 78 and the counter is reset. In addition, inverter 80 is coupled to an address counter 82 which controls the location in a memory 84 at which the time interval from register 78 is stored. Memory 84 may also be connected to time base 36 for recording the time at which the interval of reduced temperature occurred.

As also illustrated in FIG. 2, comparator 64 is connected to an AND gate 86 which also receives an enabling signal from switch 44. Upon detecting a rise in temperature of container 12 beyond a maximum encoded in a signal 88, comparator 64 issues a high logic level signal to AND gate 86. Provided that switch 44 is not generating a disabling signal due to the opening of lid 46 (FIG. 1), a high level logic signal is transmitted from AND gate 86 to a voice message memory 90 for inducing that circuit element to transmit a digitally encoded voice message to speech synthesis unit 30. The message may be, for example, the words "I am too hot; please turn down the heat," or "Temperature above maximum limit; please reset temperature."

The high logic level signal from AND gate 86 may also be transmitted to a high temperature history monitoring circuit 92 including elements structurally identical to the elements of a low temperature history monitoring circuit 94. Those elements include counter 74, register 78, inverter 80, counter 82, and memory 84. Monitoring circuit 94 thus memorizes the durations of the time intervals during which container 12 experienced excessively low temperatures.

Figure 3:
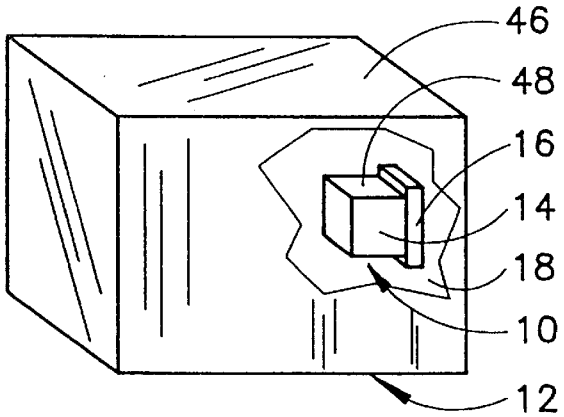
FIG. 3 is a block diagram of additional components optionally utilizable in the device of FIGS. 1 and 2.
Figure 4:
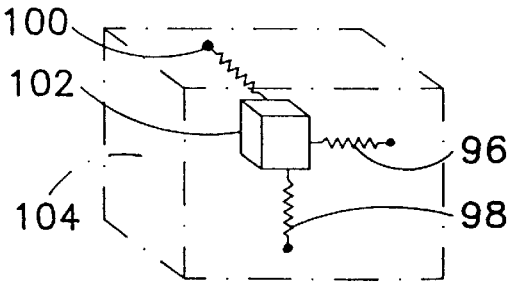
FIG. 4 is a schematic perspective view of a composite impact sensor utilizable in a device in accordance with the present invention.

As depicted in FIG. 3, device 10 may additionally comprise a plurality of impact sensors 96, 98 and 100 for detecting the sizes of impacts experienced by container 12 during shipment. As indicated in FIG. 4, sensors 96, 98 and 100 may take the form of respective strain gauges operatively connected to an inertial mass 102 and disposed together with the mass in a flexible or resilient medium 104 such as rubber.

As further depicted in FIG. 3, sensors 96, 98, and 100 are operatively connected to respective operational amplifiers or analog comparators 106, 108, and 110 which compare the outputs of the sensors with preset limits represented by signal inputs 112, 114, and 116. Sensors 96, 98, and 100 are also connected at their outputs to respective analog-to-digital converters 118, 120, and 122 which in turn are connected at their outputs to respective memories 124, 126, and 128. The digital output signals of converters 118, 120, and 122 are stored in memories 124, 126, and 128 at addresses determined by the contents of respective address counters 130, 132, and 134. The contents of counters 130, 132, and 134 are incremented upon the appearance of a high level logic signal at the outputs of operational amplifiers 106, 108, and 110.

Counters 130, 132, and 134 also control the writing process in memories 124, 126, and 128. Counters 130, 132, and 134 are disabled by a low-level logic signal from switch 44 upon the opening of container 12. This disabling prevents the writing of further impact information into memories 124, 126, and 128 and effectively locks the memories from erasure or further writing.

Time base 36 may be operatively connected to memories 124, 126, and 128 so that the times of the different impacts may be recorded.

Figure 5:
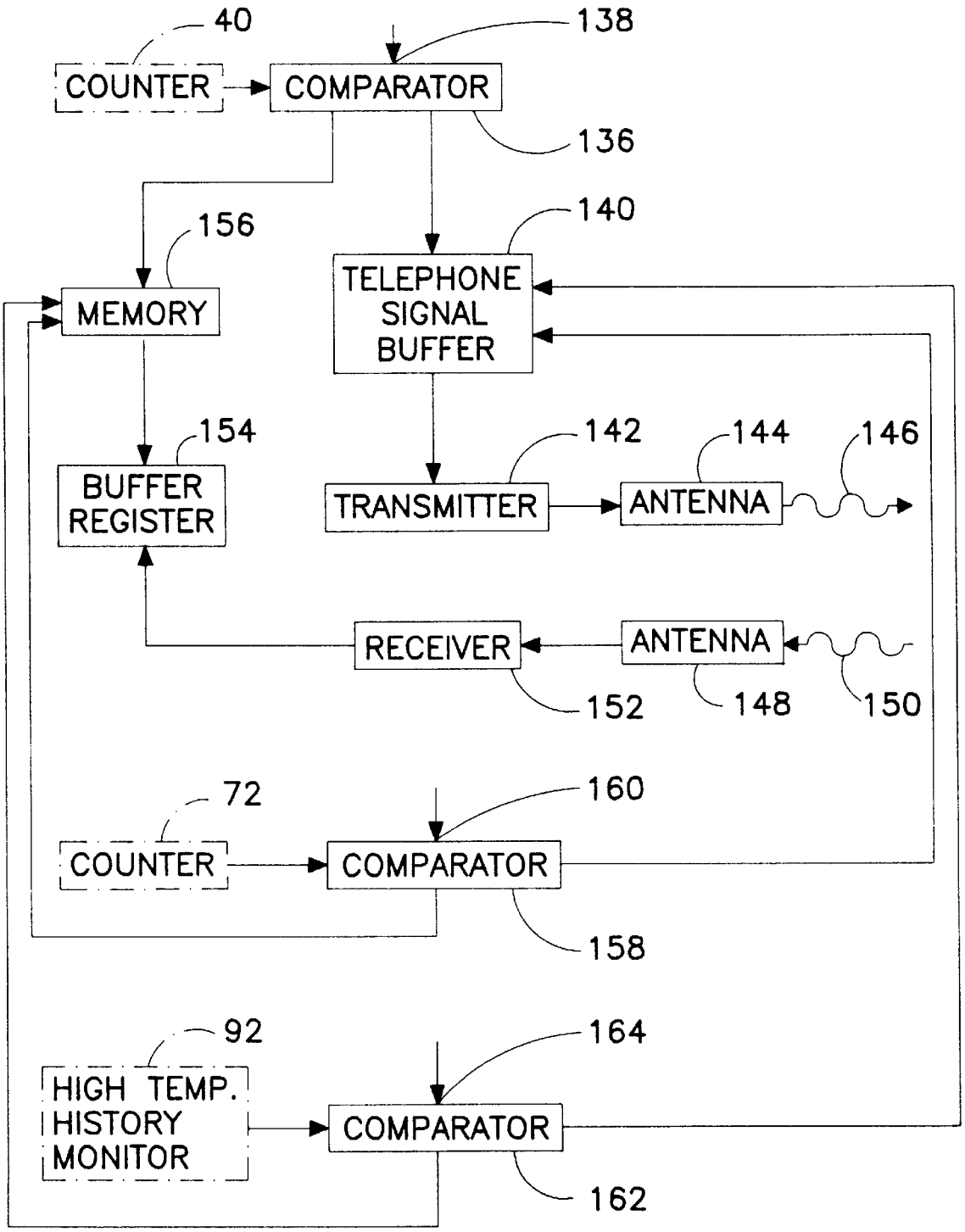
FIG. 5 is a block diagram of other components of the protective device of FIGS. 1 and 2, in accordance with the present invention.

FIG. 5 depicts components of protective device 10 (FIGS. 1 and 2) for generating an alarm or a message at a remote location when container 12 (and the contents thereof) has had a physical condition of a prescribed type for longer than a predetermined period. If that condition lasts for an extended period, damage may result to the contents of the container. Generally, the components of FIG. 5 serve as a back-up where an alarm generated at the container 12 has been ineffective to induce shipping, handling or caretaker personnel to rectify the undesired physical condition.

Counter 40 (FIG. 2) is connected at an output to a comparator 136 which has a second input 138 to which a signal representing a pre-established time interval is applied. Comparator 136 is coupled at an output to a telephone signal generator 140 of a type common in cellular telephones. Signal generator 140 produces a preprogrammed telephone signal which is amplified and otherwise prepared for long-distance transmission by a transmitter 142. The telephone signal from transmitter 142 is transmitted to a remote telephone station or computer via an antenna 144. The emitted signal 146, like conventional cellular telephone signals, may be reflected or relayed by a satellite.

Antenna 144 or, alternatively, a dedicated receiving antenna 148 picks up a confirmation signal 150 from the remote station. Confirmation signal 150 is detected by a receiver 152 which generates an enabling signal fed to a buffer register 154 for inducing the transmission of the contents of the buffer register to the remote telephone station or computer via transmitter 142 and antenna 144.

Comparator 136 has a second output which addresses a memory 156 to read out, to buffer register 154, a message that container 12 has been disposed in an undesired orientation for longer than the pre-established time interval encoded at the reference input 138 of comparator 136. This message preferably includes an identification of the particular container (and its contents), as well as a code for the type of undesired physical condition (misorientation), and may additionally identify the destination of the container and encode the duration of the undesired physical condition.

Emitted telephone signal 146 may be used by conventional triangulation or tracking technology to determine the precise geographic location of container 12. This geographic information may be useful in determining who is responsible for container 12, for example, where container 12 is transported by multiple shippers in seriatim.

As shown in FIG. 5, counter 72 (FIG. 2) is connected at an output to a comparator 158 which has an input 160 receiving a reference signal encoding a pre-established time interval. Upon determining that the output of counter 72 is equal to that pre-established time interval, comparator 158 issues a trigger signal to telephone signal generator 140 and a respective address signal to memory 156. In response to the address signal, memory 156 feeds to buffer register 154 a previously stored message. The message informs a person or computer at the remote telephone station that container 12 has had, for a time longer than the pre-established time interval encoded at the reference input 160 of comparator 158, a temperature lower than the predetermined minimum threshold encoded in the input signal 66 to comparator 62 (FIG. 2). This message includes an identification of the particular container (and its contents), as well as a code for the type of undesired physical condition (low temperature), and may additionally identify the destination of the container and encode the duration of the low temperature.

As further shown in FIG. 5, high-temperature history monitor 92 (FIG. 2) is connected at an output to a comparator 162 which has an input 164 receiving a reference signal encoding a pre-established time interval. Comparator 162 determines whether container 12 (and its contents) has had an impermissibly high temperature for longer than that pre-established time interval. If so, comparator 162 issues a trigger signal to telephone signal generator 140 and a respective address signal to memory 156. The trigger signal initiates the establishing of a long-distance telecommunications link, while the address signal induces memory 156 feeds to buffer register 154 a predetermined message. The message informs a person or computer at the remote telephone station that container 12 has had, for a time longer than the pre-established time interval encoded at the reference input 164 of comparator 158, a temperature higher than a predetermined maximum threshold.

It is to be noted that various refinements and optional capabilities may be provided for the functions described hereinabove with reference to FIG. 5. For example, history information pertaining to container 12 may be transmitted wirelessly via transmitter 142 and antenna 144, either upon the occurrence of an alarm condition, or periodically. Back-up telephone signalling codes may be provided in telephone signal generator 140, in the event that the first telephone station is busy. Alternatively, an automatic redialing feature may be provided.

Although the invention has been described in terms of particular embodiments and applications, one of ordinary skill in the art, in light of this teaching, can generate additional embodiments and modifications without departing from the spirit of or exceeding the scope of the claimed invention. It is to be noted, for instance, that the recording of time intervals of unsafe storage or shipping conditions may be implemented merely by storing the times that the intervals begin and the times at which they end. The durations may be computed subsequently from the time data.

Accordingly, it is to be understood that the drawings and descriptions herein are profferred by way of example to facilitate comprehension of the invention and should not be construed to limit the scope thereof.

What is claimed is:

1. A protective device for storage and transport containers, comprising:

sensing means for detecting a physical condition of a predetermined kind;

attachment means for securing said sensing means to a container;

a timer operatively connected to said sensing means for determining that the detected physical condition has continued longer than a preselected duration, said timer further including a timing means operatively connected to said sensing means for measuring a time interval indicating the duration of the detected physical condition; a memory means operatively connected to said timing means for automatically storing said time interval in encoded form; and a wireless telecommunications transmitter operatively connected to said timer for establishing a wireless telecommunications link to a predetermined remote receiver and transmitting, over said link to said receiver, a message that said detected physical condition has existed longer than said predetermined duration.

2. The device defined in claim 1 wherein said physical condition is orientation, said sensing means including components for detecting that the container is in an orientation other than a predetermined preferred orientation.

3. The device defined in claim 2, wherein said timing means is operatively connected to said sensing means such that said time interval measures a duration in which the container is in an orientation other than said preferred orientation.

4. The device defined in claim 3, further comprising means operatively connected to said timing means and said memory means for deactivating said timing means and for locking said memory means to ensure integrity of contents of said memory means upon an opening of the container.

5. The device defined in claim 1 wherein said physical condition is temperature, said sensing means including means for detecting that the container has a temperature beyond a predetermined threshold.

6. The device defined in claim 5, wherein said timing means is operatively connected to said sensing means such that said time period measures a duration in which the container is in a temperature range beyond said threshold.

7. A method for use in protecting contents of storage and transport containers, comprising:

automatically and at least periodically monitoring a storage and transport container with fragile contents to detect whether the container has a pre-established physical condition;

in the event that the container has the pre-established physical condition, automatically determining whether the container has had the pre-established physical condition for a time interval longer than a preselected duration automatically measuring a time interval during which the pre-established physical condition is determined and automatically storing said time interval in encoded form in a memory;

upon determining that the container has had the pre-established physical condition for a time interval longer than said preselected duration, establishing a wireless telecommunications link to a predetermined remote receiver; and upon the establishing of said link, transmitting, over said link to said receiver, a message that the container has had the pre-established physical condition for a time interval longer than said preselected duration.

8. The method defined in claim 7 wherein said physical condition is an orientation other than a predetermined preferred orientation, the monitoring of said container including detecting that the container is in an orientation other than said preferred orientation.

9. The method defined in claim 8, wherein said step of automatically measuring said time interval comprises automatically measuring a time interval during which the container is in an orientation other than said preferred orientation.

10. The method defined in claim 9, further comprising locking said memory to ensure integrity of contents of said memory upon an opening of the container.

11. The method defined in claim 7 wherein said physical condition is a temperature beyond a predetermined threshold, the monitoring of said container including detecting that the container has a temperature in a range beyond said predetermined threshold.

12. The method defined in claim 11, wherein said step of automatically measuring said time interval comprises automatically measuring a time interval during which the container is in a temperature range beyond said threshold.

13. The method defined in claim 7, further comprising automatically generating an alarm signal cognizable within a region about said container, upon detecting that the container has said pre-established physical condition.

14. The method defined in claim 13 wherein the generating of said alarm signal includes producing a sound wave via an electroacoustic transducer.

15. The method defined in claim 14 wherein the producing of said sound wave includes producing a voice message.

* * * * *